United States Patent [19]

Kayes

[11] Patent Number: 4,921,055

[45] Date of Patent: May 1, 1990

[54] SOIL DISPLACEMENT HAMMER

[76] Inventor: Allan G. Kayes, Elwin, Boyce's Hill, Newington, Sittingbourne, Kent, United Kingdom

[21] Appl. No.: 110,719

[22] PCT Filed: Dec. 19, 1986

[86] PCT No.: PCT/GB86/00780

§ 371 Date: Aug. 13, 1987

§ 102(e) Date: Aug. 13, 1987

[87] PCT Pub. No.: WO87/03924

PCT Pub. Date: Jul. 2, 1987

[30] Foreign Application Priority Data

Dec. 20, 1985 [GB] United Kingdom ..... 8531382

[51] Int. Cl.[5] ..... E21B 7/04

[52] U.S. Cl. ..... 175/45; 175/73

[58] Field of Search ..... 175/19, 45, 61, 62, 175/73, 107, 267, 269; 299/30; 405/154, 157

[56] References Cited

U.S. PATENT DOCUMENTS

| | | | |
|---|---|---|---|
| 2,316,409 | 4/1943 | Downing | 175/73 |
| 2,350,986 | 6/1944 | Collins . | |
| 3,529,682 | 9/1970 | Coyne et al. | 175/45 |
| 3,630,295 | 12/1971 | Coyne et al. | 175/73 |
| 3,853,185 | 12/1974 | Dahl et al. | 175/45 |
| 3,952,813 | 4/1976 | Chepurnoi et al. | 173/91 |
| 4,144,941 | 3/1979 | Ritter | 175/19 |
| 4,416,339 | 11/1983 | Baker et al. | 175/73 X |

FOREIGN PATENT DOCUMENTS

| | | |
|---|---|---|
| 3408244 | 9/1985 | Fed. Rep. of Germany . |
| 1191739 | 5/1970 | United Kingdom . |
| 2134152 | 1/1982 | United Kingdom . |
| 2147035 | 8/1984 | United Kingdom . |

*Primary Examiner*—William P. Neuder

*Attorney, Agent, or Firm*—Darby & Darby

[57] ABSTRACT

Soil displacement hammer for driving holes in the ground, comprising a substantially cylindrical body (5), a soil displacement head (1) at a forward end of the body, a longitudinally reciprocable striking member (12) housed within the body, and an anvil member (13) within the body adjacent its forward end and adapted to receive hammer blows from the striking member to cause the body to be driven forward. A retractable baffle member (4) is mounted adjacent the forward end of the body and is moveable between a retracted position in which it does not project from the body so that the soil displacement hammer describes a straight path in the ground, and an extended position in which it projects transversely from one side of the body to cause the soil displacement hammer to describe a curved path in the ground. The invention also provides a method of tracking such a soil displacement hammer in the ground.

4 Claims, 5 Drawing Sheets

RECEIVER SYSTEM (TWO REQUIRED)

SOIL DISPLACEMENT HAMMER

This invention relates to a soil displacement hammer. More particularly, the invention relates to a steerable soil displacement hammer for driving holes in the ground, and a method of tracking its position as it moves through the ground.

Soil displacement hammers, commonly referred to as "moles", can be used to install pipes, cables or conduits in the round without the necessity for excavating a continuous trench. Soil displacement hammers of this kind are described, for example, in GB-A-2134152 and GB-A-2147035. Existing moles do not have the capability of being steered or tracked during their passage through the ground. This restricts their application to use over relatively short distances. Furthermore, the directional stability of conventional moles can be affected by the nature of the ground, resulting in deviations from an intended route, which cannot be detected or corrected.

An object of the present invention is to overcome these limitations.

According to one aspect of the invention, there is provided a soil displacement hammer for driving holes in the ground, comprising a substantially cylindrical body, a soil displacement head at a forward end of the body, a longitudinally reciprocable striking member housed within the body, and an anvil member within the body adjacent its forward end and adapted to receive hammer blows from the striking member to cause the body to be driven forward, characterised in that a retractable baffle member is mounted adjacent the forward end of the body and is movable between a retracted position in which it does not project from the body so that the soil displacement hammer describes a straight path in the ground, and an extended position in which it projects transversely from one side of the body to cause the soil displacement harmer to describe a curved path in the ground.

The baffle member, also referred to herein as a steering plate, can be mounted to slide in and out rom the body, or alternatively it can be hinged to the body. It is preferably capable of moving outwards and forwards eccentrically and at an angle inclined to the cylindrical body of the mole. The diameter of the eccentric steering plate, when viewed in front or rear elevation, may be equal to that of the mole. The plate may be operated hydraulically, pneumatically or mechanically.

The position of the steering plate along the length of the mole will depend on the profile, length and angle of the plate. It is possible to have more than one such plate, and the angle of such plate(s) can be varied to alter the behaviour of the mole. In fact it is possible to make the mole react in completely the reverse manner to that described by changing the angle of the plate(s). Different profiles of the plate(s) will also make the mole react in different ways.

In an alternative embodiment, the retractable baffle member comprises a sleeve portion dependent from a head portion mounted at the forward end of the body, the head portion being adapted to swivel about the said forward end to permit one side of the sleeve portion to project from one side of the body.

The mole is preferably designed to be rotatable about its longitudinal axis, by remote control as it is being driven through the ground. It is then only necessary for the steering plate to be capable of projecting from one side of the body, as the body itself can always be rotated so that the mole can be caused to steer in any desired direction.

There may be one or more steering plates positioned around the circumference of the mole at its front end and operated individually or collectively. The plates may be spring loaded so as to remain in the retracted position within a housing when not activated. The housing containing the plates is attached to the front of the hammer unit and a soil displacement head is fitted in front of the plate housing. The displacement head may rotate freely.

The casing of the hammer unit is preferably contained within a cylindrical earth sleeve so that the mole assembly can be rotated within this sleeve. The outer surface of the earth sleeve is preferably fitted with stabiliser fins and engages with the soil during progress through the ground. Rotation of the mole assembly within the sleeve can be achieved by a variety of methods. For example, it can be achieved using a pneumatic or hydraulic piston operating a push/pull flexible cable through a helical guide. This device is positioned at the rear of the whole assembly and is activated by remote control. An alternative method involves the use of an air or hydraulic motor.

According to another aspect of the invention, there is provided a method of tracking a steerable soil displacement hammer in the ground, which comprises emitting a signal from the soil displacement hammer which is indicative of its position and/or direction of movement in the ground, receiving said signal at a trolley on the ground surface, and comparing the received signal with the known position of the trolley to compute the position of the soil displacement hammer.

Angular orientation of the steering plate about the longitudinal axis can be determined by means of a rotary/electronic encoder which translates angular displacement into electrical signals. These can be fed back to a control point by means of a cable attached to the motive power air hose.

Reference is now made to the accompanying drawings illustrating preferred embodiments of the invention, in which.

Figure 1:
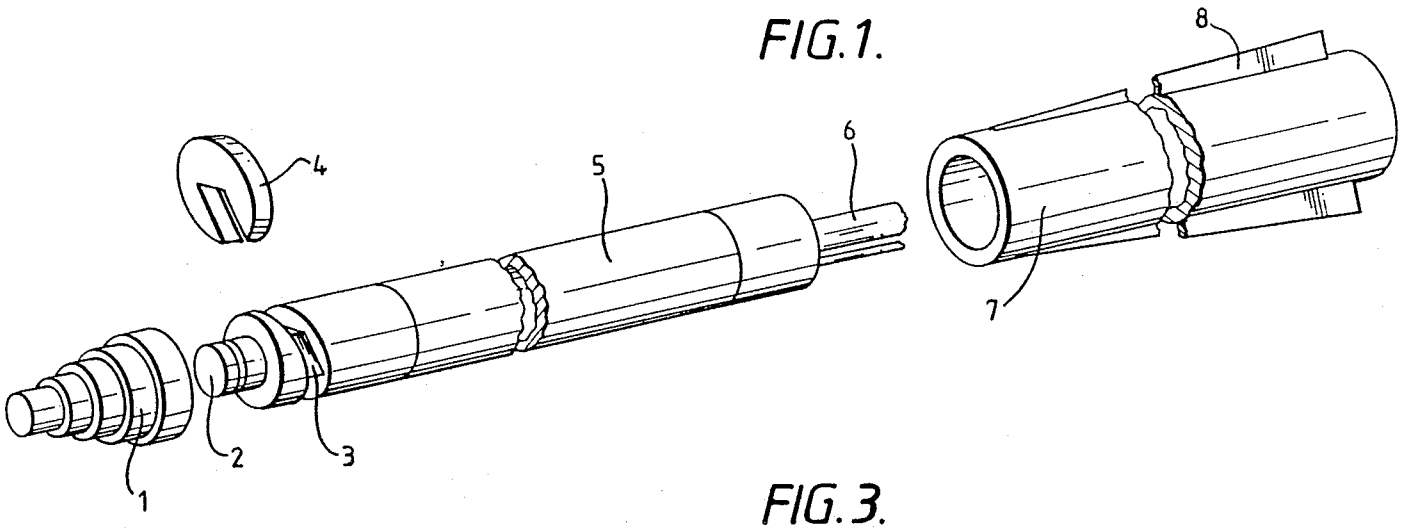
FIG. 1 is a diagrammatic exploded view of a steerable mole assembly showing the principal features.
Figure 8:
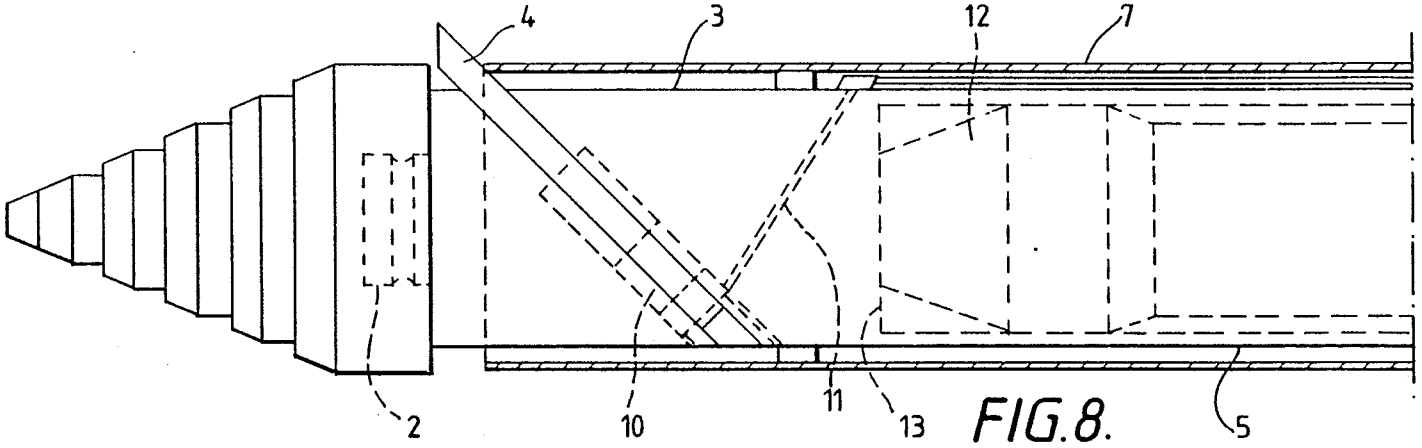
FIGS. 8 and 9 are part sectional side views showing internal details of the front and rear ends respectively, of the mole assembly.
Figure 9:
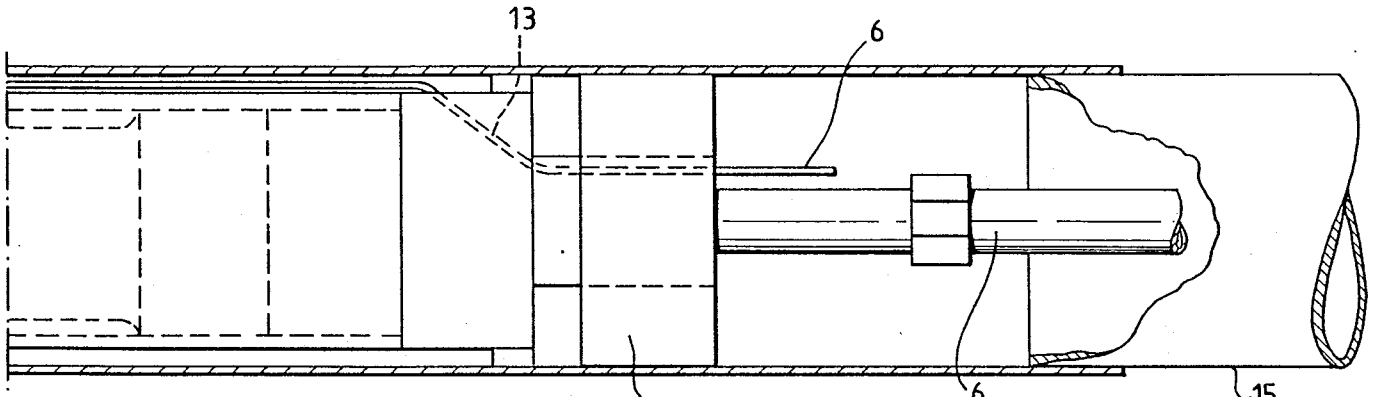

Referring now to FIGS. 1, 8 and 9, the mole assembly is of generally conventional construction, except for the steering plate assembly. A soil displacement head 1 is attached at the forward end of the mole body on a spigot/rotary bearing 2. Immediately behind the soil displacement head is a steering plate housing 3 provided with an eccentrically mounted. Substantially circular steering plate 4 which is slidable in and out of the steering plate housing. The steering plate has a substantially rectangular cut-out portion which is slidable on a corresponding rectangular part within the housing. The steering plate shown is operated by a hydraulic piston 10, a hydraulic feed pipe 11 being provided along the length of the mole. A spring may be installed to assist return of the steering plate.

Behind the steering plate housing is the conventional hammer assembly 5 provided with air hose and cables 6. An earth sleeve 7, provided with stabiliser fins 8, is slidably mounted around the hammer assembly 5. The forward end of the sleeve is slotted or castellated to allow dogs on the steering plate to lock the mole in position. Inside the hammer assembly, a reciprocable piston/striker 12 is arranged to produce hammer blows on an anvil member 13. A hydraulic motor 14 or other drive block is provided for rotation of the mole. A new pipe or duct 15 may be towed into the hole behind the mole.

Figure 10:
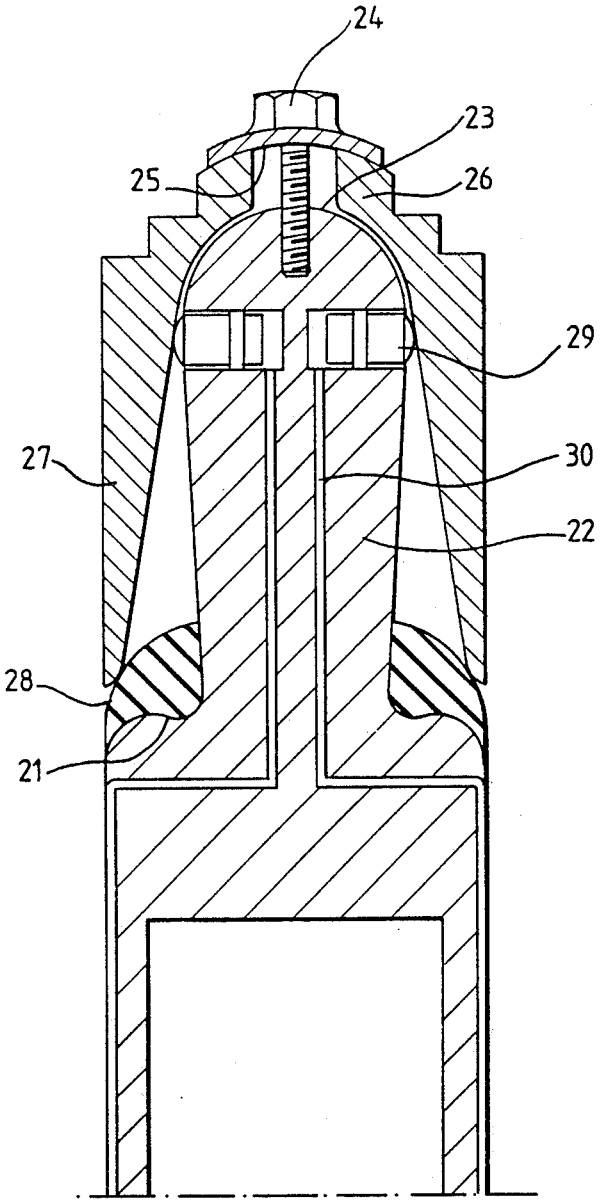
FIG. 10 is a sectional side view of the front end of a mole assembly showing an alternative embodiment of baffle member.

Referring now to the alternative embodiment of FIG. 10. The forward part of the mole has a circumferential shoulder 21 and a forwardly extending narrower portion 22 which terminates in a convex hemispherical surface 23. Engaged in the end of this surface is a bolt 24, the head of which is shaped on its underside to give a concave hemispherical surface 25 opposing and spaced apart from the surface 23. A rounded head portion 26 is slidingly engaged between the surfaces 23 and 25 such that it can swivel around the forward end of the portion 22. A hollow cylindrical sleeve portion 27 is dependent from the head portion 26. A circular rubber dirt seal 28 is disposed on the shoulder 21 and engages with the free of the sleeve portion 27. At least one hydraulically operated ram is arranged in a radial channel in the portion 22 and abuts the inner surface of the sleeve portion 27. Preferably four such rams are arranged spaced apart by 90 degrees. Actuation of the ram via the corresponding hydraulic line 30 causes swivelling of the head portion 26 such that one side of the sleeve portion 27 projects from the side of the mole body. This projection of part of the sleeve portion can be used to steer the mole in a similar manner to the projecting plate of FIG. 1.

Reference is now made to FIG. 2 to describe the technique by which the mole assembly is steered through the ground. The diagram shows a simplified profile of a steerable mole in one elevation. The mole is similar to the embodiment of FIG. 1, but similar principles will apply to the embodiment of FIG. 10. In FIG. 2*a*, the steering plate is fully retracted allowing the mole to proceed in the "straight ahead" mode. In FIG. 2*b*, activation of the steering plate causes a cavity 9 to be created behind the plate as the mole progresses through the ground. The cross sectional profile of this cavity corresponds to that of the steering plate. As shown in FIG. 2*c*, as the cavity extends along and adjacent to the earth sleeve, the ground pressure along the half circumference of the sleeve is progressively relieved. As shown in FIG. 2*d*, continued forward motion of the mole results in a turning moment being set up. This is caused by the flow of displaced soil over the head of the mole generating a higher earth pressure acting against the elongate half circumference on the opposite side to that in line with the steering plate. The mole thus begins to turn upwardly, as shown in the drawing. If the plate remains extended, the mole will describe a curved path in the ground. If the steering plate is then retracted, the mole will once again describe a straight path.

It should be appreciated that FIG. 2 illustrates the principle of steering of the mole, and this principle applies equally to steering upwards or downwards, to the left or to the right, or at any intermediate angle.

The rate of turning (and hence the turning circle) will be a function of (1) The length of the mole assembly, (2) The distance the steering plate protrudes, and (3) The type and nature of the ground.

It may thus be seen from the foregoing that, by rotating the mole within the earth sleeve, with the steering plate either retracted or extended, to any desired angular position in 36020 and then activating or deactivating the steering plate, the mole can be made to steer in any desired direction.

In order that the steering mechanism previously described can be used effectively its necessary to know the precise location and direction of the mole, both in a horizontal plane parallel to the ground surface, and in a vertical plane. It is also necessary to know the depth of the mole and the distance that it has travelled.

Figure 3:
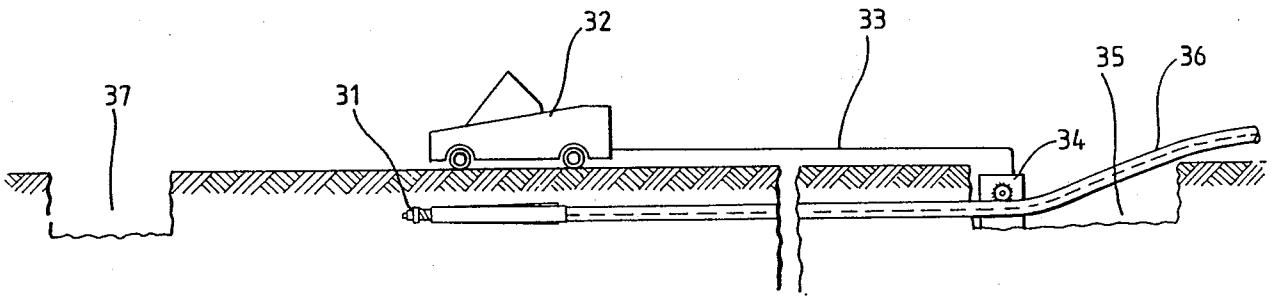
FIG. 3 is a diagrammatic view illustrating the principle of tracking the soil displacement hammer in the ground.
Figure 2A:
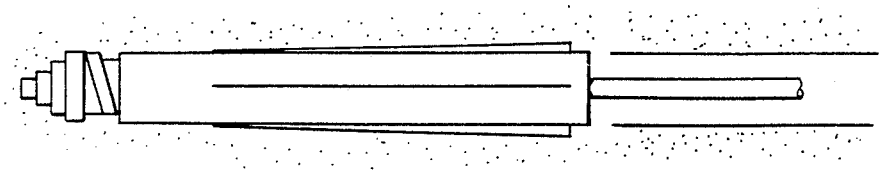
FIG. 2 illustrates diagrammatically the displacement steering sequence effected by the steering plate.
Figure 2B:
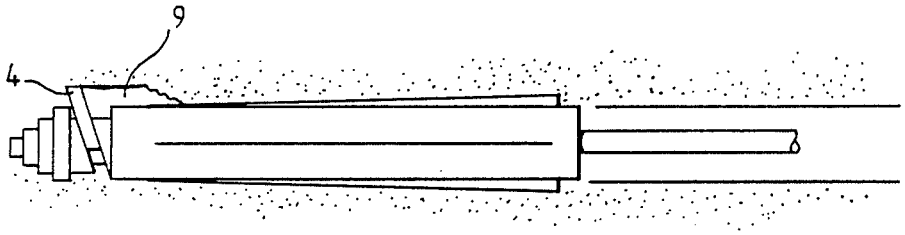
Figure 2C:
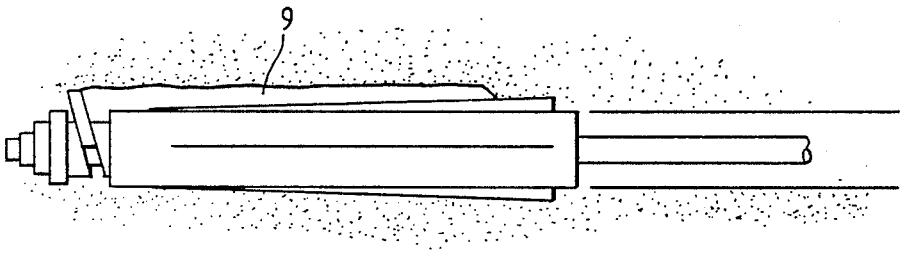
Figure 2D:
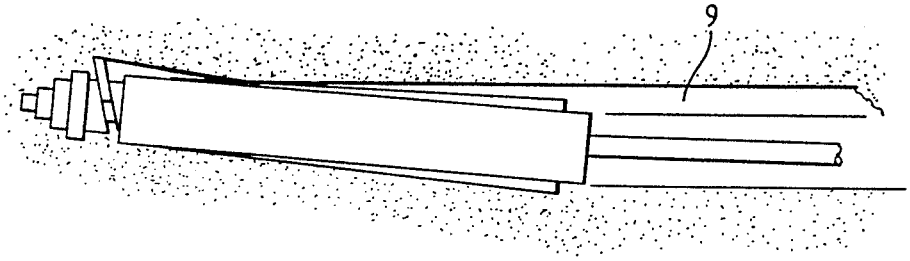

The detection of the direction of the mole in a horizontal plane parallel to the ground surface is illustrated in FIG. 3. The mole 31 is shown forming a hole through the ground from a launch excavation 35 to a reception excavation 37, a pipe or conduit 36 being pulled along behind the mole. A mole tracker trolley 32 moves on the ground surface above the path followed by the mole, and is provided with an aerial and oscilloscope as described below. A wheel-driven meter 34 measures the distance travelled by the mole and passes this information as an electrical signal through a line 33 to the trolley.

The mole assembly is connected to the pipe or conduit to be installed with the motive power air hose and other signal cables etc. being fed through the pipe or conduit. As the mole passes through the ground, the distance which it travels is measured using the wheel driven meter 34 in contact with the surface of the pipe or conduit. An electrical output signal from this meter is fed via the cable 33 to the mole tracker trolley 32 and displayed as a digital quantity. A second similar meter, driven from the wheels of the trolley itself, gives a similar digital display of the distance travelled by the trolley. The trolley is moved forward at a rate which keeps the second digital reading at the same value as the first reading. Thus, the mole and trolley move in unison and the distance travelled from the launch excavation is known exactly.

A radio signal transmittor is provided at the launch excavation position and feeds a signal or required strength to an emitter point on the mole assembly. The signal is fed to the mole along a co-axial cable attached to the motive power air hose. A sweeping aerial is fitted to the mole tracker trolley 32 and oscillates from side to side across the path of the mole underground. The aerial picks up the radio signal from the mole and feeds it to an oscilloscope mounted on the trolley. The peak signal strength occurs when the aerial is directly over the mole and is displayed on the oscilloscope as a peak in the trace. The centre line of the oscilloscope is kept aligned with the intended route to be followed by the mole, which may be shown as a chalk line on the ground surface. Any change in the direction of the mole (which may be caused for example by its striking a rock underground) will cause a lateral shift in the peak signal trace. The direction of the mole in a horizontal plane parallel to the surface is therefore known, and can be corrected or changed as desired. The sweeping aerial may be replaced by one or more receiving sensors which operate in an equivalent fashion.

The elevation or pitch of the mole i.e. its direction in a vertical plane, can be determined from an electronic inclinometer installed within the body of the mole. This instrument comprises a closed glass vial containing a bubble of gas, an electrically conducting liquid and electrodes to make external electrical contact. As the vial is tilted movement of the bubble is detected electronically and an electrical signal dependent on the tilt angle is produced. A suitable instrument is the Electrolevel made by the Tilt Measurement Limited of Baldock, Herts. Electrical signals from this inclinometer are fed via cable to the tracker trolley. Signals from a second inclinometer mounted on the trolley are compared with those from the inclinometer on the mole. This provides a comparison of the pitch of the mole relative to the pitch of the ground surface. Hence, any steering correction can be made to maintain the path of the mole corresponding to the contour of the ground surface.

At the commencement of moling from the launch excavation, the depth of ground cover over the mole is known exactly, as the mole is exposed and this can be simply measured. This measurement represents the starting datum reference for computing the depth of cover at any point during the passage of the mole through the ground. This is achieved by monitoring the signal from the inclinometer within the mole referred to above, at increments of forward travel triggered by impulses from the wheel driven meter referred to above. These two sources of data are fed to a micro processor which computes the actual depth of the mole on a continuous basis. This information can also be displayed on the mole tracker trolley.

There are four separate sensing systems which detect and transmit data regarding the position and direction of the mole and relay this data as signals to displays on the trolley on the surface. These four sensing systems are:

(1) Steering plate angular position detection;
(2) Inclinometer on mole,
(3) Inclinometer on trolley, and
(4) Distance travelled by mole.

All these signals are displayed on the surface trolley using conventional displays or, after signal processing, using a micro processor based display terminal.

Figure 4:
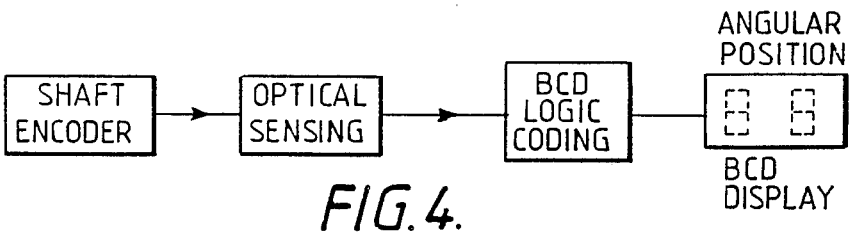
FIG. 4 is a block diagram illustrating the determination of angular orientation of the steering plate.

FIG. 4 shows the detection of the angular position of the steering plate. This is sensed using an optical shaft encoder or a tilt encoder fitted inside the mole. The output from the optical shaft encoder is transmitted to a BCD logic coding means which code it into BCD (Binary Coded Decimal) logic which can then be displayed directly by seven segment numeric displays.

Figure 5:
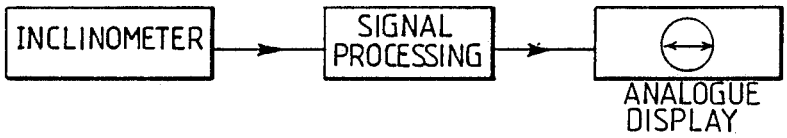
FIG. 5 is a block diagram illustrating the detection of the angle of incline of the mole and of the trolley.

The inclinometer sensing is illustrated in FIG. 5. The inclinometers fitted to both the mole and the trolley have identical sensors and signal processing. The display indicates the angle relative to the horizontal of each inclinometer and hence indicates if the mole or trolley moves out of the horizontal plane. The analogue needle display or simulation is used to indicate movement away from the horizontal. Using data from both inclinometers, the depth of the mole can be monitered continuously.

Figure 6:
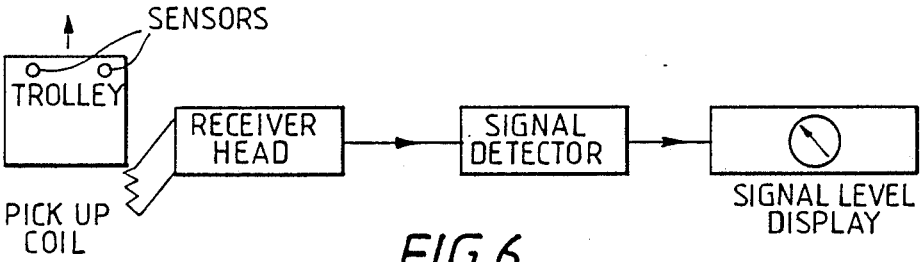
FIG. 6 is a block diagram illustrating the detection of the horizontal path followed by the solid displacement hammer.

The detection of the position of the mole in a horizontal plane parallel to the ground surface is shown in FIG. 6. The trolley moves along a predetermined path marked on the surface of the ground at the same rate as the mole. It therefore has to monitor the actual mole position to determine if the preset course is being cut correctly. The mole carries a coded signal LF RF transmitter, the signal from which is received by two receiving sensors mounted on the trolley. If the two receiving sensors are equidistant from the mole (i.e. the mole is centrally placed beneath the trolley) then the received signals are equal. If, however, the mole departs from its preset course then the imbalance in signals is displayed and suitable action can be taken.

Figure 7:
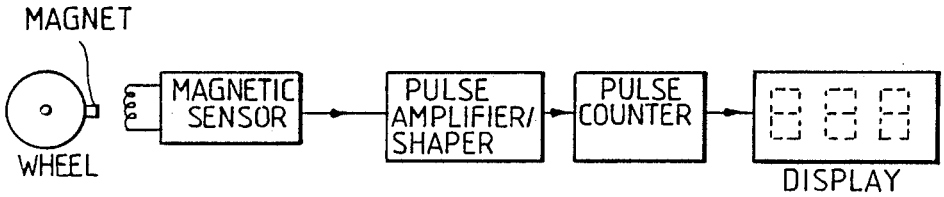
FIG. 7 is a block diagram illustrating the detection of the distance travelled by the soil displacement hammer in the ground.

The detection of distance travelled by the mole is illustrated in FIG. 7. The distance is measured by a wheel driven meter with an electronic sensor which provides a pulse for every revolution of the wheel. The pulses are counted electronically and displayed as a distance reading.

I claim:

1. A soil displacement hammer for driving holes in the ground, comprising a substantially cylindrical body, a soil displacement head at a forward end of the body, a longitudinally reciprocal striking member housed within the body, and an anvil member within the body adjacent its forward end and adapted to receive hammer blows from the striking member to cause the body to be driven forward, comprising retractable baffle means mounted adjacent the forward end of the body so as to be movable between a retracted position in which it does not project from the body and an extended soil-engaging position to which it projects transversely from one side of the body for diverting said hammer in the direction of projection of said baffle means, whereby the solid displacement hammer describes a straight path in the ground when said baffle is retracted and describes a curved path in the ground when said baffle is extended.

2. A soil displacement hammer according to claim 1, in which the retractable baffle member is shaped as a plate and is mounted to slide between its retracted position and its extended position.

3. A soil displacement hammer according to claim 1, in which the retractable baffle member comprises a sleeve portion dependent from a head portion mounted at the forward end of the body, the head portion being adapted to swivel about the said forward end to permit one side of the sleeve portion to project from one side of the body.

4. A soil displacement hammer according to any of claims 1 to 3, in which at least one of the substantially cylindrical body or the soil displacement head is rotatable about its longitudinal axis.

* * * * *